United States Patent [19]

Pribble

[11] Patent Number: 4,591,206

[45] Date of Patent: May 27, 1986

[54] TABLE ATTACHMENT FOR CHAIRS

[76] Inventor: Elvern G. Pribble, 2327 E. Pleasant St., Davenport, Iowa 52803

[21] Appl. No.: 646,732

[22] Filed: Sep. 4, 1984

[51] Int. Cl.[4] ..... A47B 83/02

[52] U.S. Cl. ..... 297/148; 297/153; 297/161; 297/194

[58] Field of Search ..... 297/148–151, 297/153, 155, 161, 194

[56] References Cited

U.S. PATENT DOCUMENTS

| | | | |
|---|---|---|---|
| 146,888 | 1/1874 | Downing | 297/149 X |
| 187,680 | 2/1877 | Taylor . | |
| 845,222 | 2/1907 | David . | |
| 854,298 | 5/1907 | Matthews | 297/161 |
| 1,222,455 | 4/1917 | Packwood, Sr. | 297/151 |
| 1,324,503 | 12/1919 | Hirsch | 297/161 |
| 1,634,929 | 7/1927 | Blitz et al. | 297/161 |
| 2,704,116 | 3/1955 | Scanlon | 297/150 |
| 2,746,526 | 5/1956 | Loeschnigg et al. | 297/194 |
| 2,828,807 | 4/1958 | Skeoch | 297/372 |
| 3,606,449 | 9/1971 | Whybrew et al. | 297/153 X |

*Primary Examiner*—William E. Lyddane
*Assistant Examiner*—Peter R. Brown
*Attorney, Agent, or Firm*—Henderson & Sturm

[57] ABSTRACT

A table attachment is provided for attachment to the arms of a chair such as a lawn chair, director's chair, some types of wheelchairs, etc. A typical chair has a pair of arm rests. The invention provides a pair of supports, one for and adapted to be mounted on and to lie lengthwise of each arm rest. A table member is attached to the front ends of the supports by peg and hole devices arranged so that the table may not only be removed from spanning relation to the supports but may be remounted (or initially mounted) on but one support, the peg and hole devices being arranged so as to provide for a plurality of positions of the table as respects the supports. Each support is further pivoted to its arm rest on a vertical axis so as to be capable of selective lateral swinging. The parts may be folded for temporary storage within a folding type of lawn chair, for example, without complete disassembly from the chair.

2 Claims, 8 Drawing Figures

TABLE ATTACHMENT FOR CHAIRS

BACKGROUND AND SUMMARY

The prior art abounds with tray and table attachment for chairs. Some of these attachments are pivotally mounted, some slidably mounted, etc., but all are relatively complicated and, when installed, are intended to remain assembled to the chair. For example, the U.S. Pat. No. 845,222, to David, discloses a table top or tray adapted to span the arm rests per se of a chair. Attachment of the tray to the arm rests is by means of metal clips or brackets. Removal of the tray is achieved by moving it forwardly and out of engagement with the arm rests. No provision is made for mounting the tray selectively in a plurality of positions. The U.S. Pat. No. 187,680, to Taylor, shows a chair having arms to which trays or leaves are attached by vertical pivots for swinging of the leaves oppositely apart to enable the occupant of the chair to arise from the chair. The leaves may be swung together to form table top split down the middle. The mounting means for the leaves is relatively complicated and costly.

According to the present invention, a three-piece construction provides a pair of elongated supports and a one-piece table. The supports lie atop and are pivotally attached respectively to the arm rests and normally project ahead of the arm rests. With the supports thus normally positioned, they lie generally in parallelism and the table is mounted on and crosswise of the front portions of these supports. By means of peg and hole devices, the table is capable of assuming several positions relative to the chair; e.g., directly in front, to either side, etc. The lateral positions are further enhanced by the pivotal mounting of the supports on the arm rests and also by a novel arrangement of the peg and hole devices, thus increasing the versatility of the attachment.

Further features of the invention lie in the construction of the parts from material intended to provide for extended use without deterioration, which material is also inexpensive (e.g., good grade pine); the parts are easily manufactured, involving only simple fabrication procedures; the supports may be duplicates of each other, further increasing manufacturing ease and reducing costs; the parts are easily mounted on chairs of many types and may be just as easily removed when desired.

The foregoing features and advantages, as well as others, will become apparent as a preferred embodiment of the invention is disclosed herein.

DESCRIPTION OF A PREFERRED FORM OF THE INVENTION

Although a typical folding lawn chair is shown as the base to which the inventive attachment is mounted, such illustration should be taken as representative and not limiting, for there are many forms of arm chair to which the attachment is or can be adapted.

Figure 1:
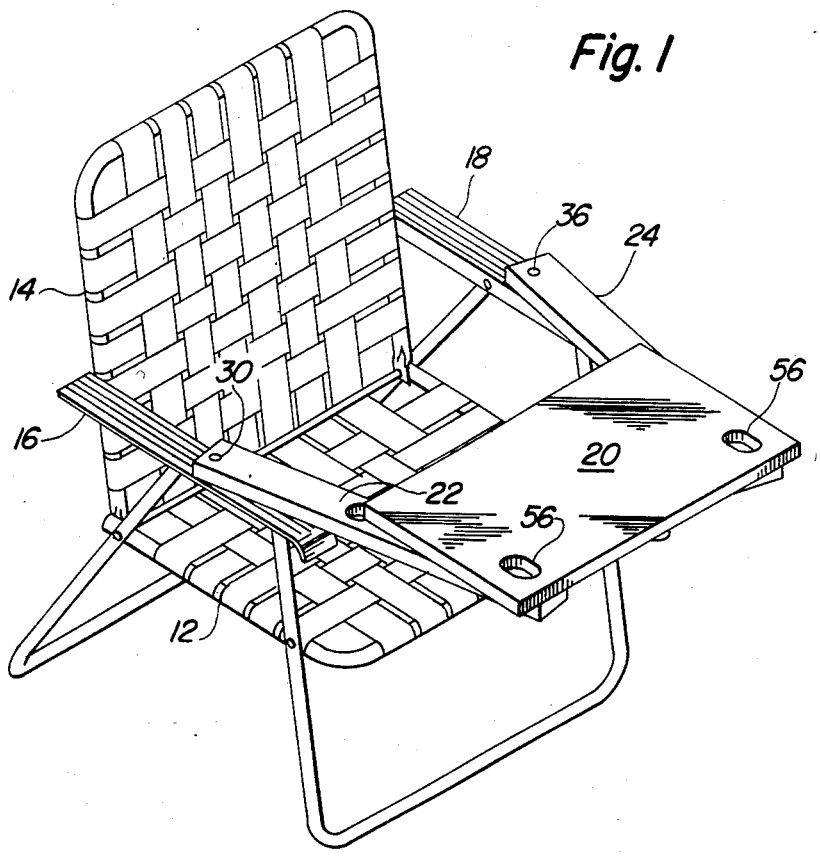
FIG. 1 is a perspective showing the attachment mounted on a typical lawn chair, the attachment assuming a straight-ahead position.
Figure 2:
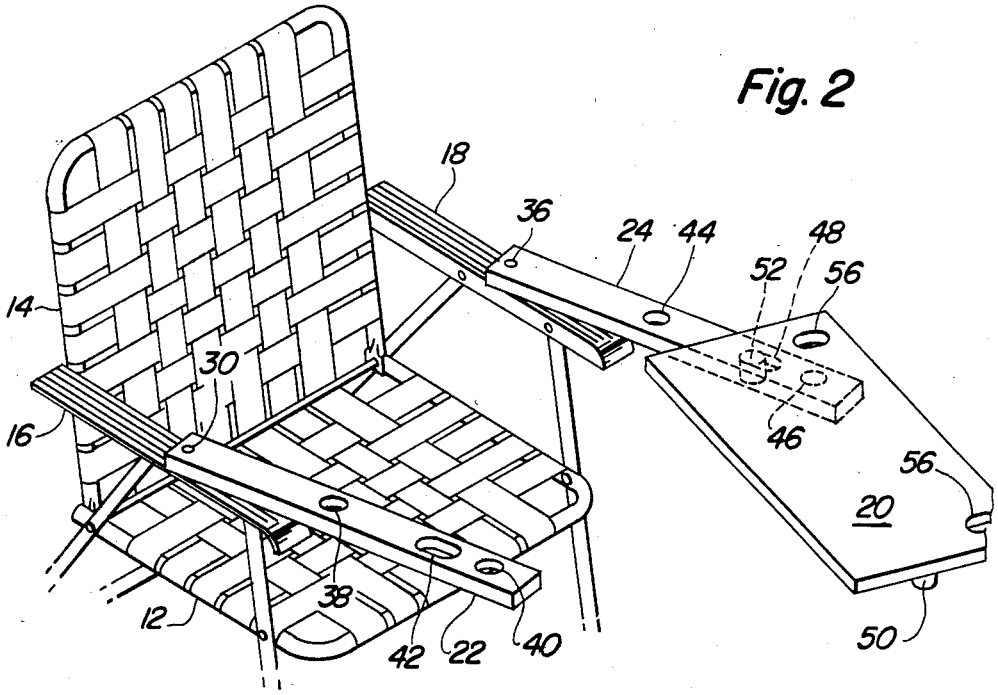
FIG. 2 is a similar view, with portions omitted, showing a table in a position swung laterally to the left of the chair.
Figure 7:
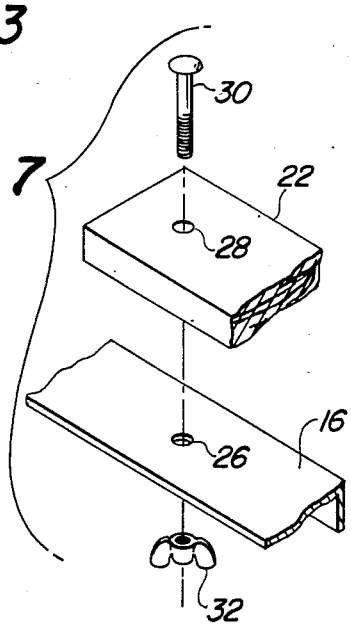
FIG. 7 is an "exploded" perspective of the nature of the assembly of the support to an arm rest.
Figure 8:
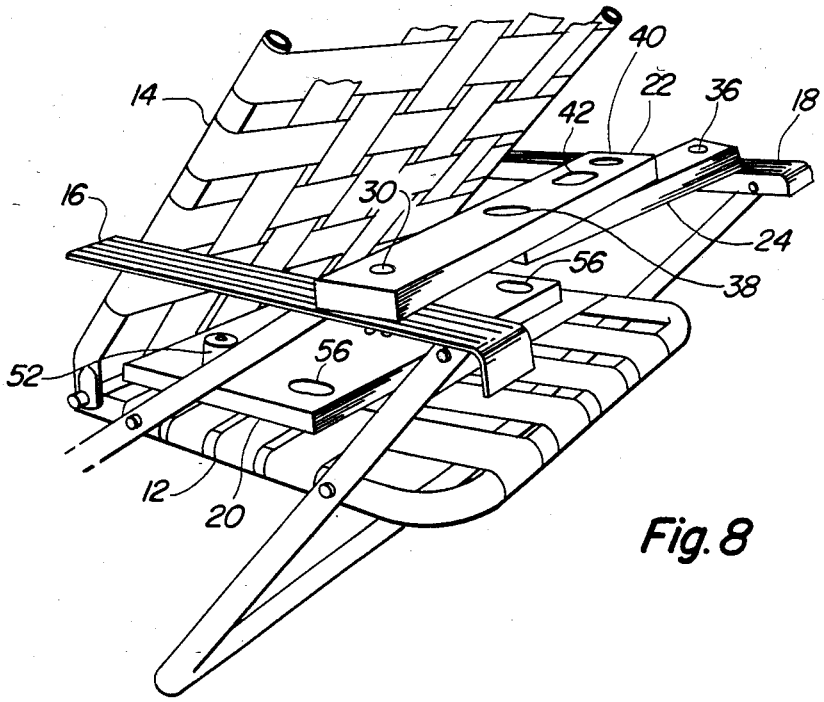
FIG. 8 is a perspective, with portions omitted, showing a folded position of the supports and receipt of the table member by the chair during folding of the chair.

In the drawings, the chair per se is denoted by the numeral (10) as having a seat (12), a back (14) and right and left arm rests (16) and (18) respectively. The novel table attachment comprises three basic parts, to wit, a table member (20) and right and left supports (22) and (24) respectively. These parts may be of any suitable material, such as a good grade of pine; although, the nature of the material is not significant in the patentable sense. Each support is mounted on its associated arm rest by means best depicted in FIG. 7, wherein it is shown that the arm rest (16) is drilled to provide a hole or bore (26) for alinement with a bore (28) in the support. The support is placed atop the arm rest with the bores alined to receive a carriage bolt or the like (30), which is passed downwardly through the bores to receive a wing nut 32, for example. Like means is used at the left side of the structure, a bore (34) being seen in the left support (24) (FIG. 3) and a pivot bolt (36) being seen in FIGS. 1, 2 and 8. The presence of the left wing nut can be assumed, as can a suitable bore in the left arm rest. The arm rest bores are drilled by the user of the attachment. As will appear subsequently herein, the mounting bolts and related parts provide for selectively lateral positioning of the supports.

Figure 3:
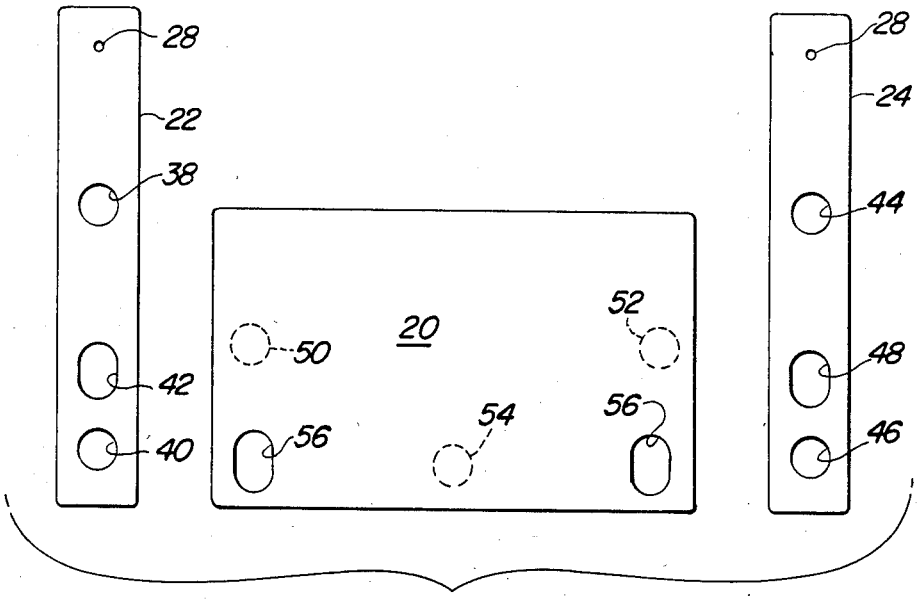
FIG. 3 is an "exploded" elevation of the three basic parts of the attachment prior to assembly and mounting on the chair.

Each support is of elongated nature so, when pivotally mounted to its respective arm rest, it projects fairly substantially ahead of the arm rest and the two supports may be arranged to lie in general parallelism; although, exact parllelism is not a factor so long as the front ends of the supports are positioned so as to properly support the table member. As best shown in FIG. 3, the right support is provided with two circular holes (38) and (40) spaced apart lengthwise of the support, with an oval or like hole (42) interveining. Three similarly arranged holes (44), (46) and (48) are formed in the left support (24). The holes (40) and (46) are located at the front ends of the respective supports.

Figure 4:
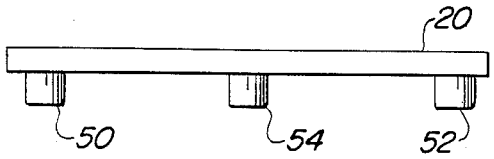
FIG. 4 is an end view of the table member per se.

Also as best seen in FIG. 3 (and see also FIG. 4), the table member has three pegs or dowels (52), (50) and (54) rigid therewith. These pegs are triangularly arranged, with the central peg (54) equi-distant from the side pegs (50) and (52). Further, the distance between the holes (38) and (40) in the right support (22) equals the distance between the peg (54) and either peg (50) or (52), all for a purpose of presently appear. The same is true as respects the spacing of the holes (44) and (46) in the left support (24). The table member also has a pair of oval holes (56), similar to the oval holes in the supports. These are for the receipt of articles for the convenience of the occupant of the table-equipped chair; e.g., fishing rods, glasses, soda cans, etc., all of which is not vital to the patentability of the table attachment, since provision for like articles has been known in many prior chair attachments.

Figure 5:
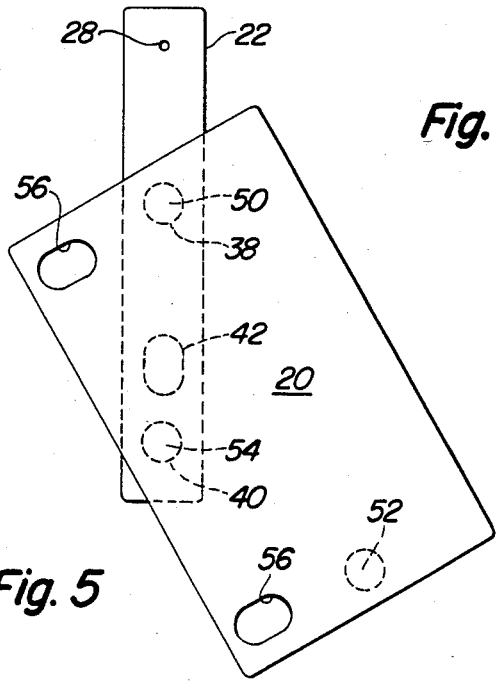
FIG. 5 is a fragmentary plan view showing one lateral position of the table member relative to a support.
Figure 6:
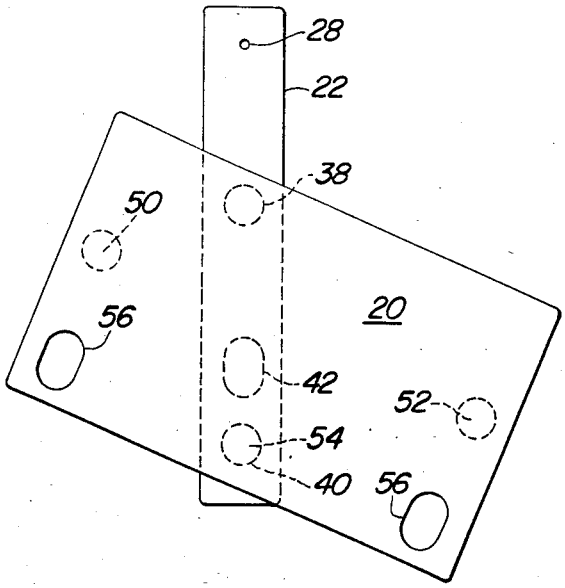
FIG. 6 is a similar view showing another position of the table member.

As stated above, the three parts may be packaged and sold as a kit. The purchaser readies the chair to which the kit is to be applied by simply drilling the arm rests at (26) and then attaching the right and left supports. See FIG. 3, for example. While seated in the chair, the user may mount the table member on the supports by inserting the table member pegs (50) and (52) respectively in the support holes (38) and (44), respectively, or (40) and (46), respectively, depending upon the desired position for the table member. Since the pegs are securely fastened to the table member, danger of their loss is prevented. The peg-to-hole fit is relatively snug to eliminate inadvertent spearation of the parts. Other positions of the table member relative to the support or supports are suggested in FIGS. 5 and 6, FIG. 5 demonstrating the advantage of the spacing relationship among the pegs in the table member and the holes in the support. In FIG. 6 only one peg and hole combination is used. Other peg and hole combinations will readily suggest themselves on the basis of what is disclosed here. The versatility of the invention is further illustrated in FIG. 8, where the supports are swung inwardly relative to each other and overlapped, which is possible because of the flexibility in the arm rests of the chair. The table member is placed in the seat of the chair and is thus retained within the chair when the chair is completely folded.

It should be understood that a presently preferred embodiment of the invention has been disclosed and that many changes and modifications can be effected; for example, reversal of parts, etc., all of which can be achieved without departure from the spirit and scope of the invention.

I claim:

1. A table attachment for a chair having a right and left arm rests, comprising right and left supports adapted to lie respectively along the right and left arm rests and being fore-and-aft elongated so as to project respectively ahead of the arm rests, each support having front and rear ends and each rear end portion including upright pivot means for the removable and laterally swingable attachment thereof to the respective arm rest, a table member dimensioned to span the mounted supports and being of rigid end-to-end construction to provide right and left end portions respectively overlaying and resting on the right and left front end portions of the supports, and right and left means respectively cooperative between the right and left end portions of the table member and the front end portions of the supports for mounting the table member on the supports, and each of said means including, for each support, front and rear similar round holes on vertical axes spaced apart lengthwise of the associated support and, for the table member, right and left round pegs depending respectively from the undersides of the right and left end portions of the member and dimensioned to snugly but turnably fit any of the holes, and a third round peg depending from the underside of the member at an intermediate portion thereof and also dimensioned to snugly but turnably fit any of the holes, wherein the distance between the first and third pegs and the second and third pegs is the same and is equal to the spacing between the front and rear holes in either support, whereby the table member may be supported on only one support by locating the intermediate peg in the forward hole of the support and one of the right or left pegs in the rear hole of the support.

2. The table attachment of claim 1, in which the pegs are arranged in triangular fashion with the distance between the first and second pegs greater than the aforesaid distance.

* * * * *